US012427366B2

(12) United States Patent
Chen et al.

(10) Patent No.: US 12,427,366 B2
(45) Date of Patent: Sep. 30, 2025

(54) FOLDING STRUCTURE FOR TREADMILL HANDLE BAR

(71) Applicant: XIAMEN MYDO SPORTS EQUIPMENT CO., LTD, Fujian (CN)

(72) Inventors: Jinshui Chen, Fujian (CN); Bingwen Liu, Fujian (CN)

( * ) Notice: Subject to any disclaimer, the term of this patent is extended or adjusted under 35 U.S.C. 154(b) by 123 days.

(21) Appl. No.: 18/581,356

(22) Filed: Feb. 19, 2024

(65) Prior Publication Data

US 2024/0238640 A1 Jul. 18, 2024

(30) Foreign Application Priority Data

Mar. 8, 2023 (CN) ..... 202320420456.8

(51) Int. Cl.
*A63B 22/02* (2006.01)
*A63B 21/00* (2006.01)

(52) U.S. Cl.
CPC ..... *A63B 21/4035* (2015.10); *A63B 22/02* (2013.01); *A63B 2210/50* (2013.01)

(58) Field of Classification Search
CPC ..... A63B 22/02; A63B 2210/50; Y10T 403/32336
See application file for complete search history.

(56) References Cited

U.S. PATENT DOCUMENTS 4,824,278 A * 4/1989 Chang ..... F16C 11/10 D25/64
2017/0239517 A1* 8/2017 Jeong ..... A63B 22/04
2023/0136863 A1* 5/2023 Luo ..... A63B 21/023 482/54
2025/0195943 A1* 6/2025 Luo ..... A63B 22/02

FOREIGN PATENT DOCUMENTS

CN 210644982 U * 6/2020 ..... A63B 21/4035
CN 214105717 U * 9/2021
CN 214232562 U * 9/2021
CN 220676636 U * 3/2024
CN 220877636 U * 5/2024
CN 220877638 U * 5/2024
CN 221950517 U * 11/2024

* cited by examiner

*Primary Examiner* — Joshua T Kennedy
(74) *Attorney, Agent, or Firm* — Birchwood IP

(57) ABSTRACT

A folding structure for treadmill handle bar, including a handle bar foldable against a supporting post, and also a position limiting member and a reset member, where a first pivotal piece is provided on a top end of the supporting post; at least two position limiting grooves are formed on the first pivotal piece; a second pivotal piece is provided at an end portion of the handle bar; the first and second pivotal pieces are coaxial; the positioning limiting member is pivotally connected to the second pivotal piece and vertical aligned with the first pivotal piece; the position limiting member has a driver part and a protrusion engageable with the position limiting grooves; and the reset member is connected with the handle bar and the position limiting piece.

7 Claims, 5 Drawing Sheets

FOLDING STRUCTURE FOR TREADMILL HANDLE BAR

BACKGROUND OF THE INVENTION

The present invention relates to the technical field of treadmill, and more specifically relates to a folding structure for treadmill handle bar.

Due to better economic development of the society, treadmills are becoming popular among household users. Large size of the treadmill occupies certain amount of space, so most users prefer folding the treadmill for storage when it is not in use.

In the field of art, a foldable treadmill is usually folded by folding vertical supporting posts of the treadmill against a base of the treadmill, and then the folded treadmill is positioned upright for storage. However, due to product enhancement, handle bars installed on the vertical supporting posts of the treadmill are no longer formed as a simple metal frame. Instead, a console integrating control and display functions are usually mounted on the handle bars. Therefore, the handle bars of the treadmill are now formed with different shapes, and their sizes are continuously increasing. Accordingly, treadmill nowadays requires foldable handle bars to facilitate folding and storage of the treadmill. However, conventional handle bars of the treadmill are usually locked to the vertical supporting posts by screws, or even formed integrally as a whole with the vertical supporting posts, and thus unfoldable.

BRIEF SUMMARY OF THE INVENTION

In view of the aforesaid disadvantages now present in the prior art, the present invention provides a folding structure for treadmill handle bar to enable folding of the handle bar against a corresponding vertical supporting post so as to facilitate storage and to reduce the space being occupied.

To attain the above objects, the present invention provides the following technical solutions:

A folding structure for treadmill handle bar, comprising a vertical supporting post, a handle bar, a position limiting member, and a reset member; a first pivotal piece is mounted at a top end of the vertical supporting post; an edge of the first pivotal piece facing towards the handle bar is provided with at least two position limiting grooves; a bottom surface of an end portion of the handle bar is provided with a second pivotal piece; the first pivotal piece and the second pivotal piece are positioned coaxially; the position limiting member is pivotally connected at the second pivotal piece and is vertically aligned with the first pivotal piece; the position limiting member comprises an operable driver part, and a protrusion engageable with said at least two position limiting grooves at an unfolded state and a folded state respectively; two ends of the reset member are connected to the handle bar and the position limiting member respectively in a way that the protrusion of the position limiting member is biased towards the first pivotal piece such that the protrusion is biased to be movably engaged with one of said at least two position limiting grooves.

An edge of the second pivotal piece facing towards the vertical supporting post is formed with an arc-shaped groove; a side surface of the first pivotal piece facing towards the second pivotal piece is provided with a position limiting column movable within the arc-shaped groove.

The first pivotal piece is formed with a first axial hole; the second pivotal piece is formed with a second axial hole.

A connection shaft is provided on the second pivotal piece; one end of the driver part sleeves the connection shaft, another end of the driver part extends away from the connection shaft to form a rod-shaped part; the protrusion is formed on an edge of the driver part facing towards the first pivotal piece.

Preferably, the position limiting member also comprises a connection part integrally formed with the driver part; the connection part and the driver part are positioned on two sides of the connection shaft respectively; the reset member is a tension spring; two ends of the reset member are connected to the handle bar and the connection part.

Preferably, a bottom surface of the end portion of the handle bar is formed with a spring hole where one end of the reset member is connected.

A gasket is mounted between the first pivotal piece and the second pivotal piece.

The present invention has the following technical effects by adopting the above technical solutions:

1) A movable position limiting member is provided between the first pivotal piece and the second pivotal piece; under the biasing force of the reset member, the position limiting member enables the first pivotal piece and the second pivotal piece to be locked with respect to each other. When user operates the position limiting member so that the first pivotal piece and the second pivotal piece are unlocked with respect to each other, the handle bar can be folded or unfolded, thereby achieving a foldable handle bar against the vertical supporting post to reduce the space required for storage.

2) The first pivotal piece and the second pivotal piece are independent from each other, and can be made of metals of high metal strength so as to strengthen and lengthen a service life of the pivotal connection between the handle bar and the vertical supporting post and prevent the end product from being too costly.

3) The present invention contains lesser components enabling easy installation and achieving high technical efficiency.

DETAILED DESCRIPTION OF THE INVENTION

To further explain the technical solutions of the present invention, the present invention is further described in detail below with reference to the accompanying drawings.

Figure 1:
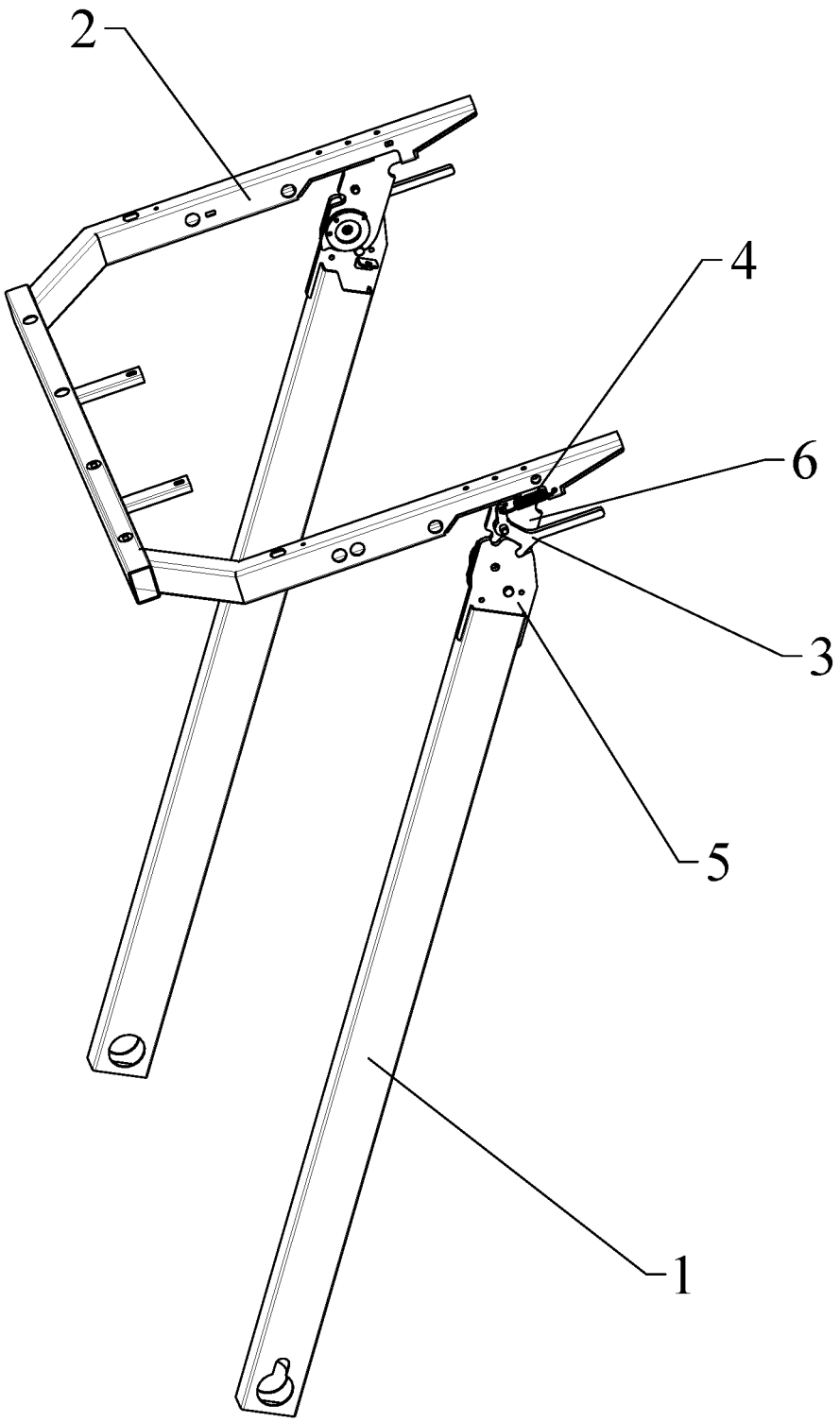
FIG. 1 is a perspective showing use of the present invention.
Figure 2:
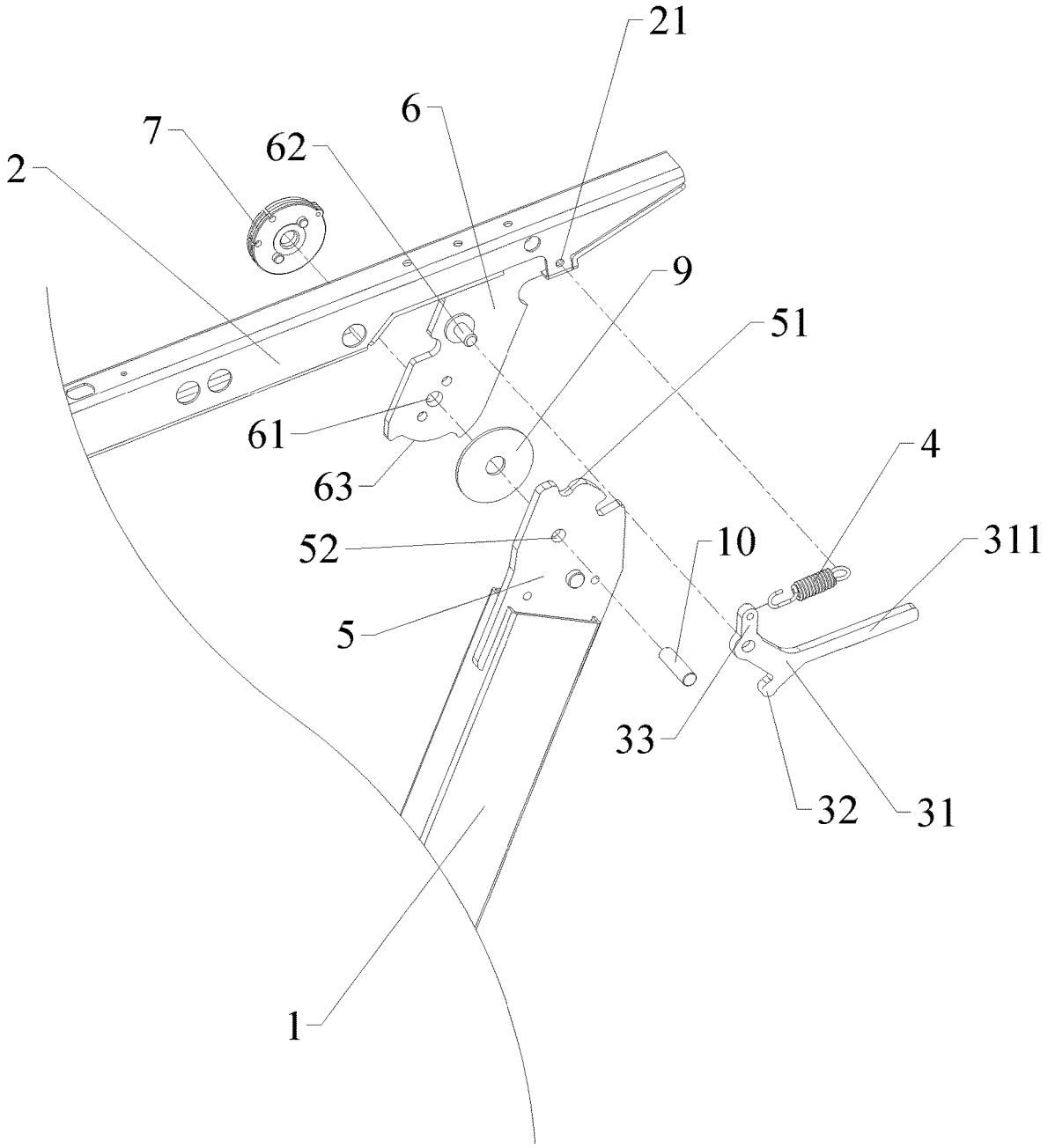
FIG. 2 is a first exploded view of the present invention.
Figure 3:
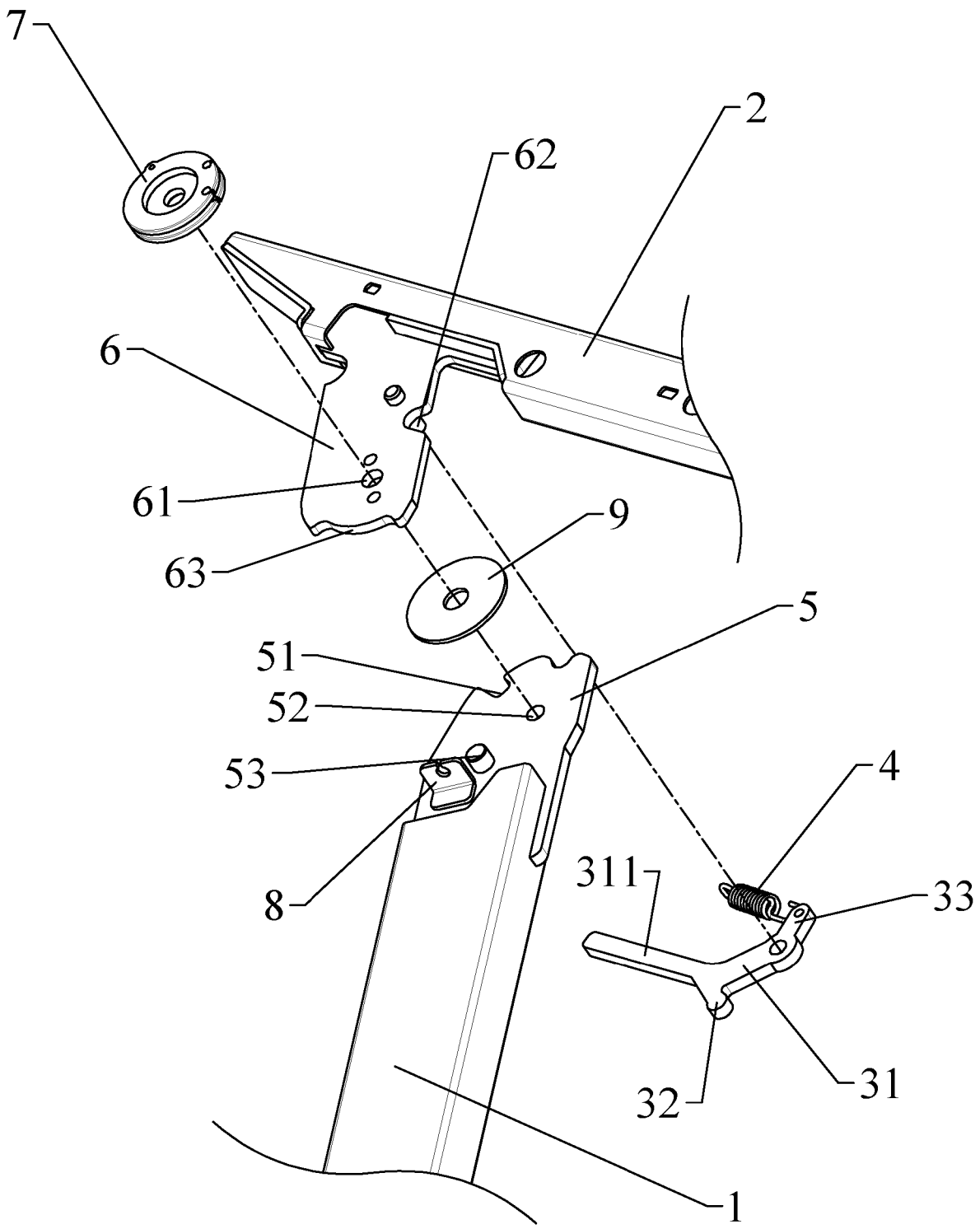
FIG. 3 is a second exploded view of the present invention.

With reference to FIG. 1 to FIG. 5, the present invention discloses a folding structure for treadmill handle bar, comprising a vertical supporting post 1, a handle bar 2, a position limiting member 3, and a reset member 4. In actual use as shown in FIG. 1, two identical folding structures can be disposed on two sides of the treadmill respectively.

A first pivotal piece 5 is mounted at a top end of the vertical supporting post 1; an edge of the first pivotal piece 5 facing towards the handle bar 2 is provided with at least two position limiting grooves 51.

A bottom surface of an end portion of the handle bar 2 is provided with a second pivotal piece 6; the first pivotal piece 5 and the second pivotal piece are positioned coaxially so that the handle bar 2 and the vertical supporting post 1 are pivotally connected to each other.

The position limiting member 3 is pivotally connected at the second pivotal piece 6 and is vertically aligned with the first pivotal piece 5; the position limiting member 3 comprises an operable driver part 31, and a protrusion 32 engageable with said at least two position limiting grooves 51 at an unfolded state and a folded state respectively.

Two ends of the reset member 4 are connected to the handle bar 2 and the position limiting member 3 respectively in a way that the protrusion 32 of the position limiting member 3 is biased towards the first pivotal piece 5 such that the protrusion 32 is biased to be movably engaged with one of said at least two position limiting grooves 51; when user operates the driver part 31, the protrusion 32 is disengaged from said one of said at least two position limiting grooves 51 so that the handle bar 2 can move pivotally about the vertical supporting post 1.

According to the above technical solutions, the present invention provides a movable position limiting member 3 between the first pivotal piece 5 and the second pivotal piece 6; under the biasing force of the reset member 4, the position limiting member 3 enables the first pivotal piece 5 and the second pivotal piece 6 to be locked with respect to each other. When user operates the position limiting member 3 so that the first pivotal piece 5 and the second pivotal piece 6 are unlocked with respect to each other, the handle bar 2 can be folded or unfolded, thereby achieving a foldable handle bar 2 against the vertical supporting post 1 to reduce the space required for storage. The first pivotal piece 5 and the second pivotal piece 6 are independent from each other, and can be made of metals of high metal strength so as to strengthen and lengthen a service life of the pivotal connection between the handle bar 2 and the vertical supporting post 1 and prevent the end product from being too costly. The present invention contains lesser components enabling easy installation and achieving high technical efficiency.

Embodiments of the present invention are described below.

Said at least two position limiting grooves 51 of the first pivotal piece 5 correspond to a use state and a folded state of the handle bar 2 respectively.

The first pivotal piece 5 is formed with a first axial hole 52; the second pivotal piece 6 is formed with a second axial hole 61; a pine 10 passes through the first axial hole 52 and the second axial hole 61 to achieve pivotal connection between the first pivotal piece 5 (and thus the vertical supporting post 1) and the second pivotal piece 6 (and thus the handle bar 2).

Further, the pin 10 is mounted with a wire wheel 7 of the treadmill, and first pivotal piece 5 is mounted with a wire passing member 8.

A connection shaft 62 is provided on the second pivotal piece 6; one end of the driver part 31 sleeve the connection shaft 62, another end of the driver part 31 extends away from the connection shaft 62 to form a rod-shaped part 311; the protrusion 32 is formed on an edge of the driver part 31 facing towards the first pivotal piece 5. By rotating the driver part 31 towards the handle bar 2 (for example, in accordance with direction shown by FIG. 1, rotating the driver part 31 upward towards the handle bar 2), the protrusion 32 is disengaged from a corresponding position limiting groove 51.

Further, the position limiting member 3 also comprises a connection part 33 integrally formed with the driver part 31; the connection part 33 and the driver part 31 are positioned on two sides of the connection shaft 62 respectively; the reset member 4 is a tension spring; two ends of the reset member 4 are connected to the handle bar 2 and the connection part 33.

Besides, the bottom surface of the end portion of the handle bar 2 is formed with a spring hole 21 where one end of the reset member 4 is connected, thereby achieving installation of the tension spring on the handle bar 2.

An edge of the second pivotal piece 6 facing towards the vertical supporting post 1 is formed with an arc-shaped groove 63; a side surface of the first pivotal piece 5 facing towards the second pivotal piece 6 is provided with a position limiting column 53 movable within the arc-shaped groove 63. An angle of pivotal rotation between the handle bar 2 and the vertical supporting post 1 is limited by the position limiting column 53 and the arc-shaped groove 63; Maximum and minimum angles of the pivotal rotation between the handle bar 2 and the vertical supporting post 1 are defined by an abutting position of the position limiting column 53 against one end of the arc-shaped groove 63 and another abutting position of the position limiting column 53 against another end of the arc-shaped groove 63 respectively. Generally, the maximum angle corresponds to the use state of the handle bar 2, and the minimum angle corresponds to the folded state of the handle bar 2.

A gasket 9 is mounted between the first pivotal piece 5 and the second pivotal piece 6; the gasket 9 separates the first pivotal piece 5 and the second pivotal piece 6 to prevent squeaky noise caused by friction between metals when the handle bar 2 is being rotated, thereby enhancing user's experience.

Figure 4:
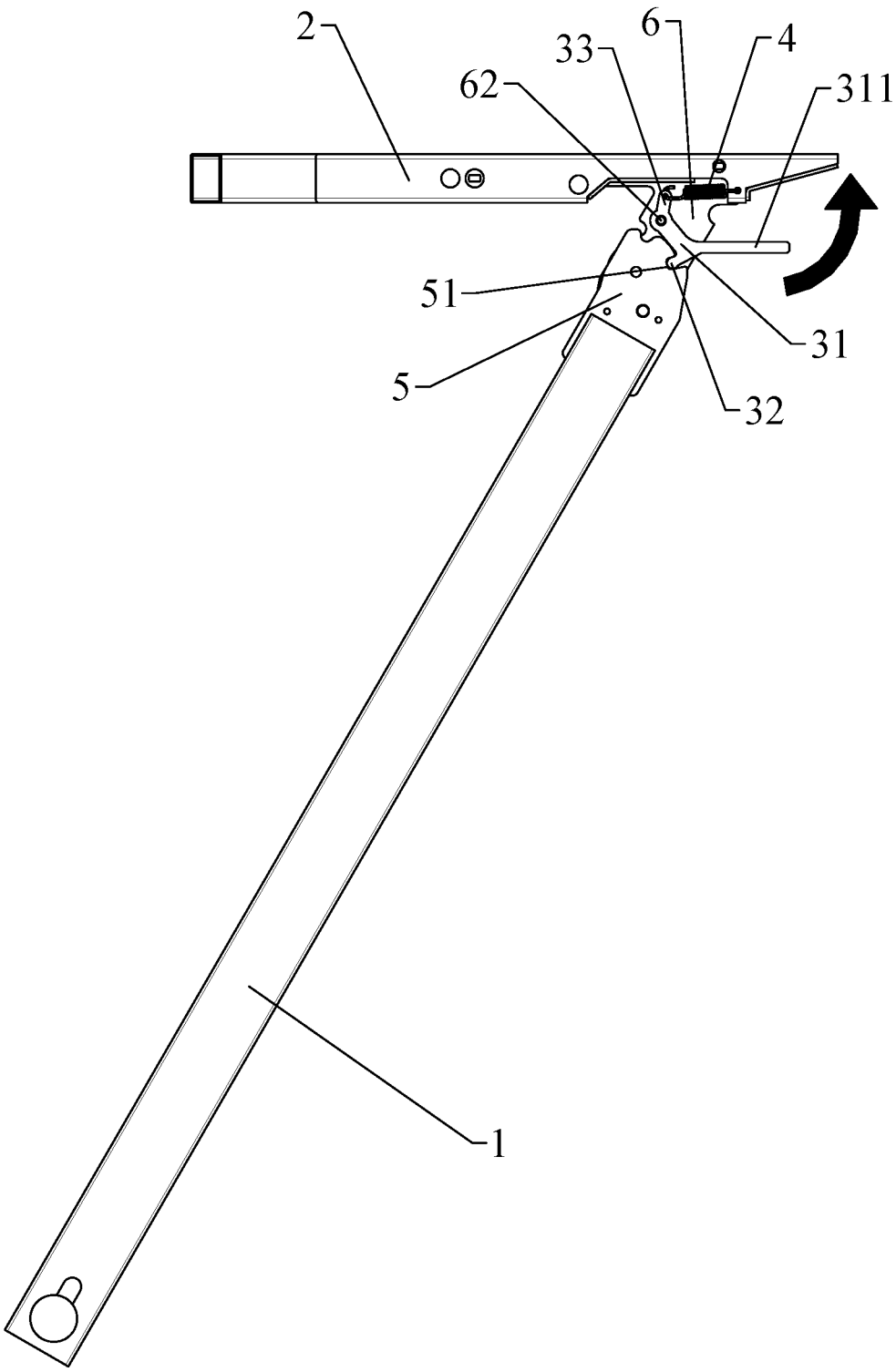
FIG. 4 is a side view showing the present invention in a use state.
Figure 5:
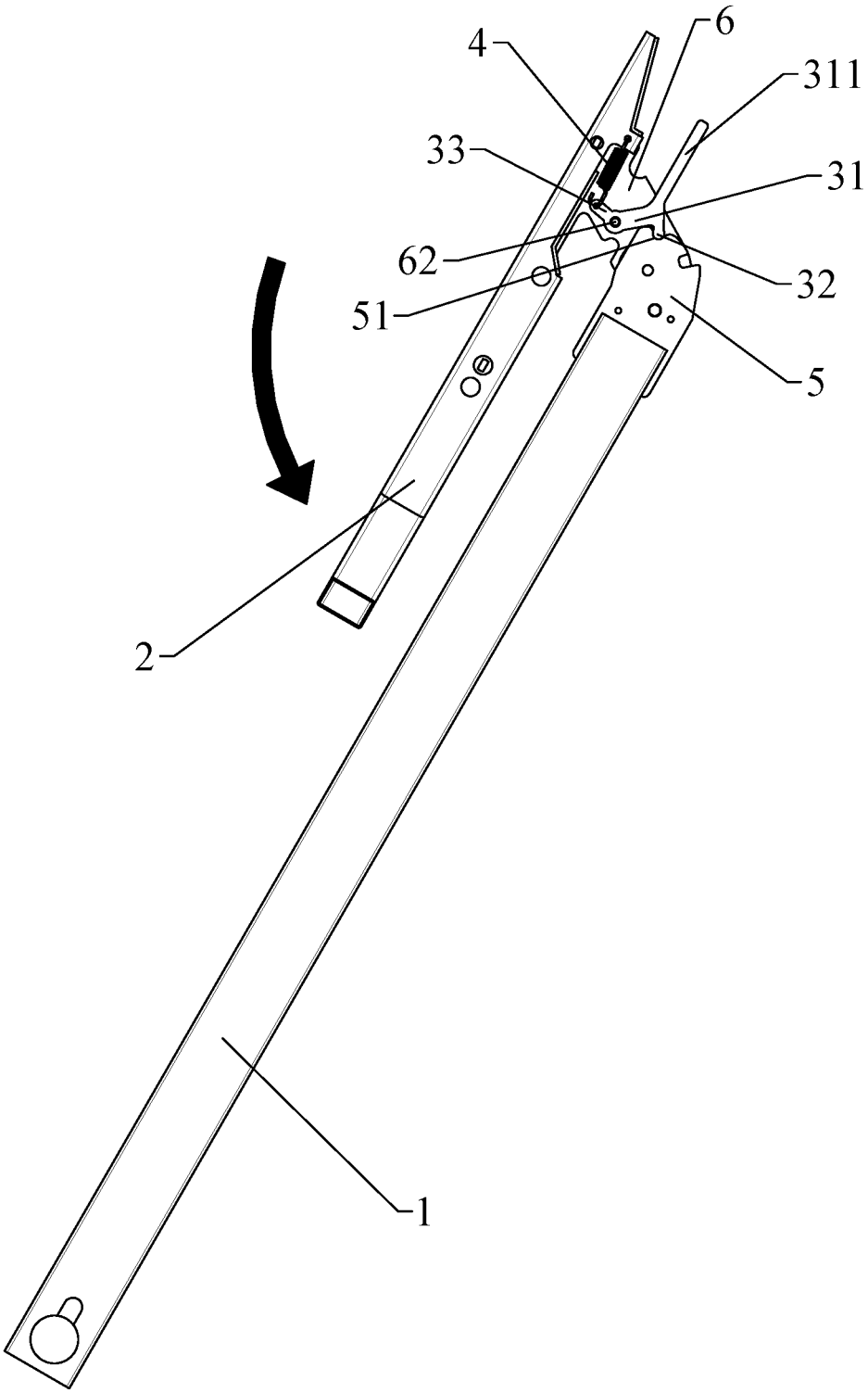
FIG. 5 is a side view showing the present invention in a folded state.

As shown in FIG. 4 and FIG. 5, the present invention operates as follows:

When user rotates the driver part 31 towards the handle bar 2, the protrusion 32 is disengaged from a position limiting groove 51, and the handle bar 2 can pivotally rotate with respect to the vertical supporting post 1; rotate the handle bar 2 downwardly so as to fold the handle bar 2 against the vertical supporting post 1 until the handle bar 2 is substantially parallel to the vertical supporting post 1 (the folding angle is limited by the position limiting column 53 and the arc-shaped groove 63); after folding, release the driver part 31 so that under the biasing force of the reset member 4, the protrusion 32 will be rotated against the first pivotal piece 5 and engaged into another position limiting groove 51, thus achieving a stable folded state of the handle bar 2 which will not easily shake and get loosened.

The above embodiments and figures are not intended to limit the form and type of the present invention. Any appropriate changes or modifications made a person skilled in the art shall not be considered deviated from the scope of the present invention.

What is claimed is:

1. A folding structure for treadmill handle bar, comprising:

a vertical supporting post, a handle bar, a position limiting member, and a reset member;

a first pivotal piece is mounted at a top end of the vertical supporting post; an edge of the first pivotal piece facing towards the handle bar is provided with at least two position limiting grooves;

a bottom surface of an end portion of the handle bar is provided with a second pivotal piece; the first pivotal piece and the second pivotal piece are positioned coaxially;

the position limiting member is pivotally connected at the second pivotal piece and is vertically aligned with the first pivotal piece; the position limiting member comprises an operable driver part, and a protrusion engageable with said at least two position limiting grooves at an unfolded state and a folded state respectively;

two ends of the reset member are connected to the handle bar and the position limiting member respectively in a way that the protrusion of the position limiting member is biased towards the first pivotal piece such that the protrusion is biased to be movably engaged with one of said at least two position limiting grooves.

2. The folding structure of claim 1, wherein an edge of the second pivotal piece facing towards the vertical supporting post is formed with an arc-shaped groove; a side surface of the first pivotal piece facing towards the second pivotal piece is provided with a position limiting column movable within the arc-shaped groove.

3. The folding structure of claim 1, wherein the first pivotal piece is formed with a first axial hole; the second pivotal piece is formed with a second axial hole.

4. The folding structure of claim 1, wherein a connection shaft is provided on the second pivotal piece; one end of the driver part sleeves the connection shaft, another end of the driver part extends away from the connection shaft to form a rod-shaped part; the protrusion is formed on an edge of the driver part facing towards the first pivotal piece.

5. The folding structure of claim 4, wherein the position limiting member also comprises a connection part integrally formed with the driver part; the connection part and the driver part are positioned on two sides of the connection shaft respectively; the reset member is a tension spring; two ends of the reset member are connected to the handle bar and the connection part.

6. The folding structure of claim 5, wherein the bottom surface of the end portion of the handle bar is formed with a spring hole where one end of the reset member is connected.

7. The folding structure of claim 1, wherein a gasket is mounted between the first pivotal piece and the second pivotal piece.

* * * * *